US006443391B1

(12) United States Patent
Malejko et al.

(10) Patent No.: US 6,443,391 B1
(45) Date of Patent: Sep. 3, 2002

(54) FIN-STABILIZED PROJECTILE WITH IMPROVED AERODYNAMIC PERFORMANCE

(75) Inventors: Gregory Malejko, Hackettstown; John C. Grau, Sussex, both of NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/859,775

(22) Filed: May 17, 2001

(51) Int. Cl.[7] ..... F42B 10/26; F42B 10/04

(52) U.S. Cl. ..... 244/3.24; 244/3.1; 244/3.23; 244/3.29

(58) Field of Search ..... 244/3.1, 3.23, 244/3.24–3.29, 3.3

(56) References Cited

U.S. PATENT DOCUMENTS 4,076,187 A * 2/1978 Metz ..... 244/3.23

6,126,109 A * 10/2000 Barson et al. ..... 244/3.28

* cited by examiner

*Primary Examiner*—Bernarr E. Gregory

(74) *Attorney, Agent, or Firm*—Michael C. Sachs; John F. Moran

(57) ABSTRACT

A projectile includes an elongated forebody and an aft section secured to the forebody. The aft section includes a pair of fins affixed to an aerodynamic, cylindrical section. The lift generated by the low-drag pair of fins is sufficient to counteract most foreseeable angles of attack to be experienced by the projectile. The aft section further includes a bearing that couples the aft section to the forebody of the projectile and is capable of allowing the aft section to rotate freely about the longitudinal axis of the projectile and independently of the forebody. Thus, during flight the aft section rotates into the maximum lift plane and provides a restoring moment to the projectile, thus providing necessary stability to the projectile while imparting minimum drag.

10 Claims, 6 Drawing Sheets

FIN-STABILIZED PROJECTILE WITH IMPROVED AERODYNAMIC PERFORMANCE

GOVERNMENTAL INTEREST

The invention described herein may be manufactured and used by or for the Government of the United States for governmental purposes without the payment of any royalties thereon.

FIELD OF THE INVENTION

This invention relates to projectiles, and it particularly relates to a method of maintaining stability while reducing the aerodynamic drag on fin-stabilized projectiles and free rockets. More specifically, the projectile incorporates a low-drag, freely rotating aft section equipped with a pair of fins that provides an adequate restoring moment to the projectile during flight to provide stability in the plane in which the projectile is pitching (the pitch plane).

BACKGROUND OF THE INVENTION

In the field of aerodynamics, as applied to projectile and free rockets, fins are often attached to the aft section of the projectile or free rocket to provide stability during flight. As used herein, the combination of projectiles and free rockets will be referred to by the term 'projectiles' but may be understood to refer to both projectile and free rockets. These tail fins provide a restoring moment to the projectile when there is a non-zero angle of attack, that is, when there is a non-zero angle between the projectile's longitudinal axis and its velocity vector. The plane that contains the angle of attack is the so-called pitch plane.

In a typical configuration, 3 to 12 fixed fins are equally spaced around the circumference of the aft section of the projectile body. The location, orientation and quantity of fins ensure that sufficient lift is generated in any plane to impart the necessary moment to reduce the angle of attack to zero and, thus, stabilize the projectile.

While the multiplicity of fixed fins achieves the desired goal of providing stability to the projectile in any and all planes, it also adds undesirable aerodynamic drag, thus reducing both the velocity and range of the projectile. In particular, it can be recognized that all fins add aerodynamic drag whether or not they are producing lift necessary to minimize angle of attack.

Yet, a simple vector analysis reveals that for a conventional, fixed-fin design the maximum resulting lift is limited to a value equal to that generated by only half the fins. In contradistinction, this invention achieves stability while minimizing the aerodynamic drag on the projectile by employing a pair of fins that rotate about the longitudinal axis of the projectile to provide maximum lift in the plane in which the projectile is pitching.

Conventional, multi-finned projectiles described above have satisfied the need to provide the lift required to counteract a non-zero angle of attack and, further, to give the projectile necessary stability. However, there is still an unsatisfied need for an improved, fin-stabilized projectile that achieves overall performance via increased range and/or downrange velocities while maintaining flight-path stability.

SUMMARY OF THE INVENTION

An objective of the present invention is to provide a new aerodynamic device, such as projectile with improved flight characteristics, especially in the area of drag control. The invention achieves this objective and features by eliminating all but two of the fins required for fin-stabilized flight of projectiles.

Another feature of the present invention is to achieve enhanced overall performance of projectiles via increased range and/or increased downrange velocities as the result of low-drag flight.

Another feature of the present invention is to achieve enhanced overall performance of projectiles without adding substantial complexity to the design or implementation of the projectiles. This objective is achieved by employing a passive system for fin-stabilized flight. The passive system comprises a 2-finned tail assembly capable of rotating independently about the longitudinal axis of the main body of the projectile. With the fins free to spin about the longitudinal axis of the projectile, the existing aerodynamic forces will always orient the fins in a plane such that they provide maximum lift to decrease the angle of attack and maintain stability.

The foregoing and additional features and advantages of the present invention are realized by a projectile that includes an elongated forebody and an aft section secured to the forebody. The aft section includes a pair of fins affixed to an aerodynamic, cylindrical section. The lift generated by this low-drag pair of fins is sufficient to counteract most, if not all foreseeable angles of attack to be experienced by the projectile.

The aft section further includes a bearing that couples the aft section to the forebody of the projectile and is capable of allowing the aft section to rotate freely about the longitudinal axis of the projectile and independently of the forebody. Thus, during flight the aft section rotates into the maximum lift plane and provides a restoring moment to the projectile, thus providing necessary stability to the projectile while imparting minimum drag.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
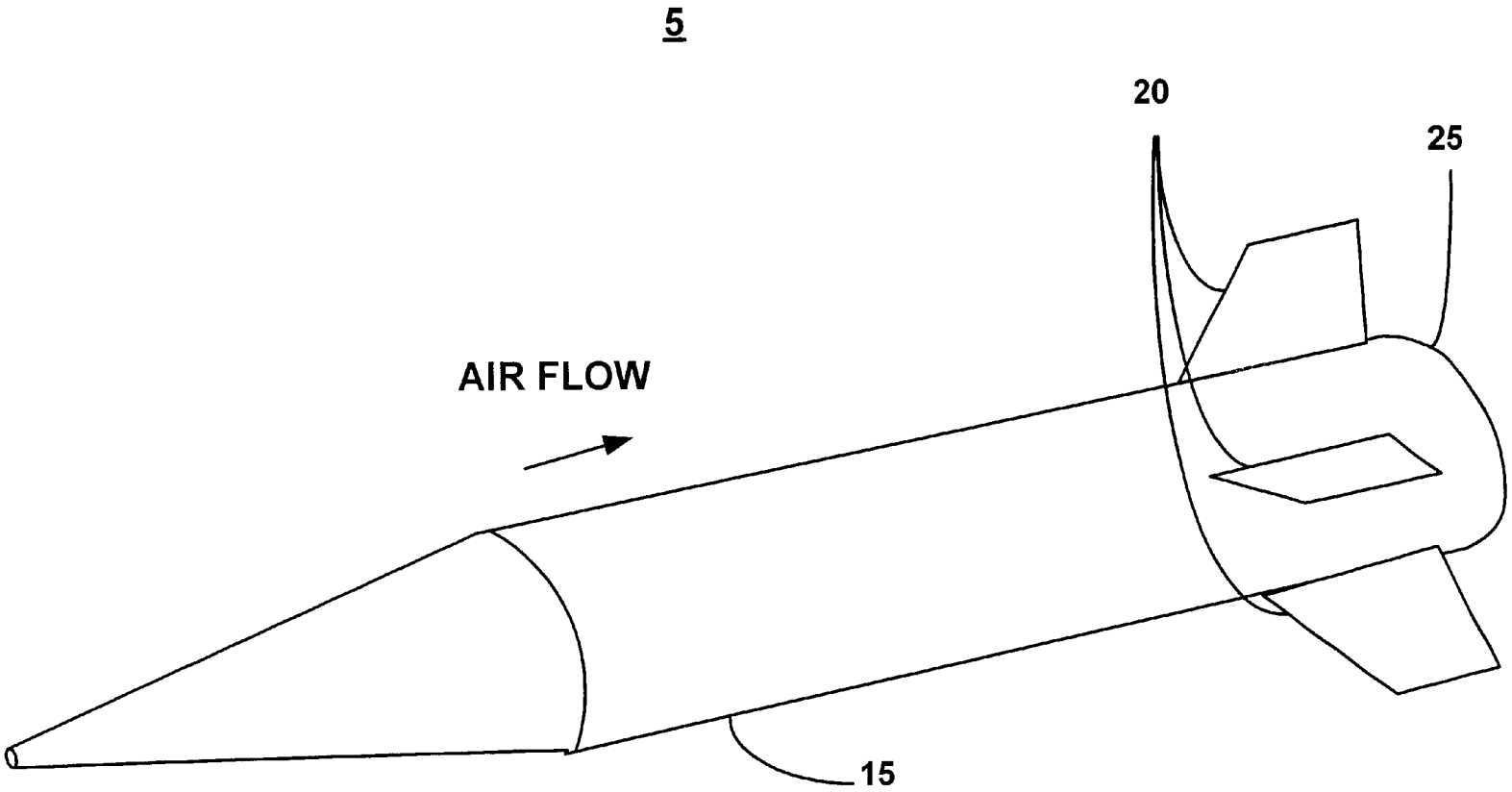
PRIOR ART FIG.1
FIG. 1 is a perspective view of a conventional finned projectile.

FIG. 1 illustrates a projectile 5 according to a conventional implementation of a fin-stabilized projectile typical of the prior art. The projectile 5 is generally formed of an aerodynamic, cylindrically-shaped forebody 15 equipped with a plurality of fins 20 at or near the tail 25 of the projectile. The projectile 5 may be, for example, a helicopter-launched, fin-stabilized, unguided rocket.

According to a typical implementation as few as three or as many as twelve equally-spaced fins are arranged around the circumference of the tail. It may be observed that a minimum of three fixed fins is necessary to ensure that lift will be generated to counteract an angle of attack in any plane. Since the amount of lift provided by three fins is often insufficient to provide adequate stability, additional fins are employed. A typical maximum is approximately 12. While superior stability is achieved with a larger number of fins, the penalty paid is increased drag, since all fins contribute to the effective drag associated with the projectile.

FIG. 2 displays lateral and rear views of the conventionally-finned projectile of FIG. 1, illustrating the pertinent aerodynamic quantities brought on by a non-zero angle of attack. As depicted, projectile 5 with a velocity vector 40 displays a non-zero angle of attack 10. In particular, the longitudinal axis of the cylindrical forebody 15 may be observed to form a non-zero angle with respect to the velocity vector 40, thus defining the angle of attack 10. A plurality of fins, equally spaced around the circumference of the tail section 25 of the projectile 5 provide the necessary lift to correct the attitude of the projectile and reduce the angle of attack, ideally to zero.

The angle of attack of the projectile may lie in any plane and the general orientation of the fins blades will be random with respect to the pitch plane. For illustration and explanatory purposes, however, consider the special case where the angle of attack lies completely in the plane of the lateral view of the projectile (the pitch plane) and the projectile, equipped with four fins, has two fins lying in the pitch plane and two lying in a plane that is orthogonal to the pitch plane.

Figure 2A:
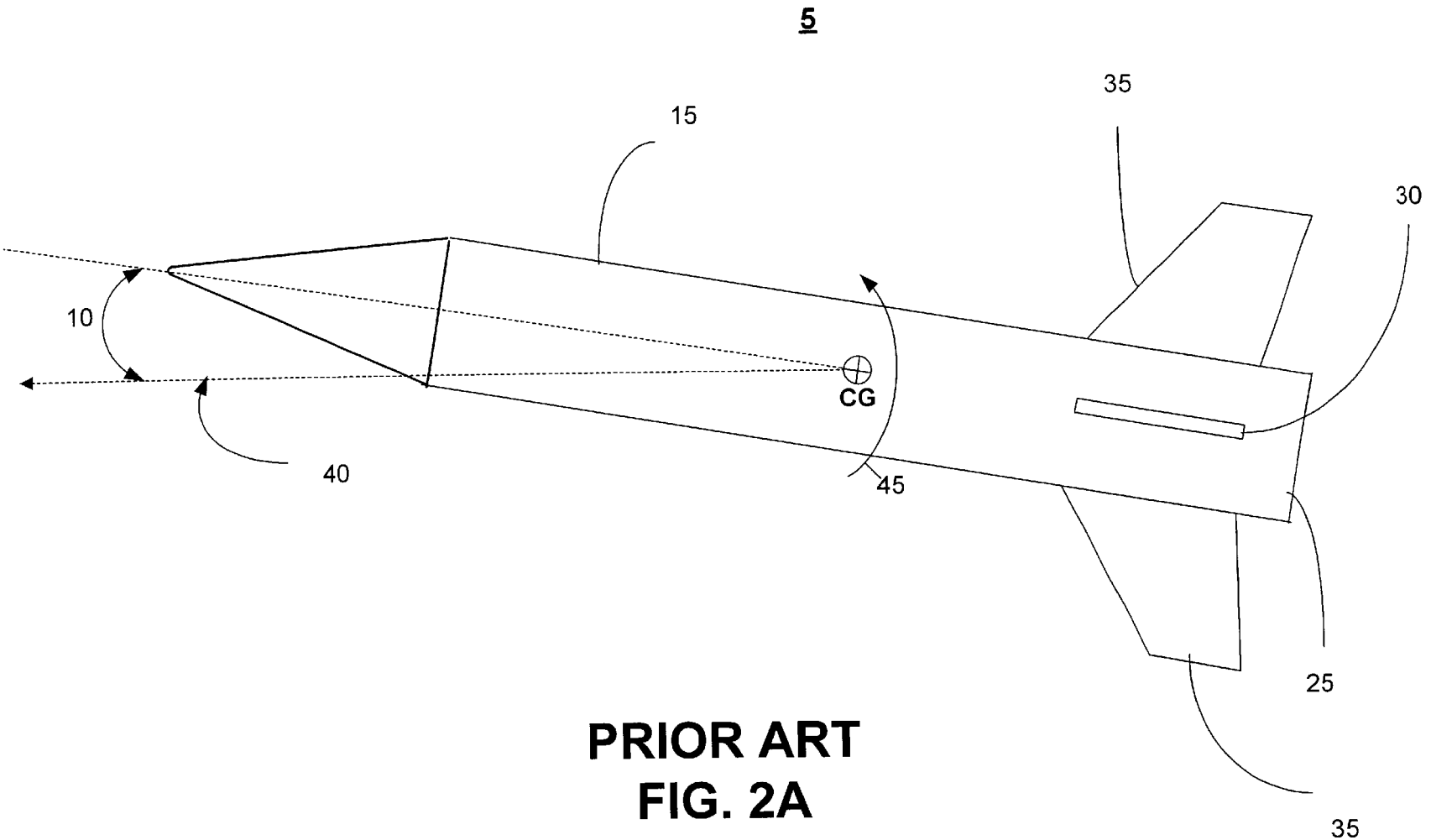
PRIOR ART FIG. 2A
FIG. 2 is comprised of FIGS. 2A and 2B, and illustrates a side view and rear view of a prior art projectile, such as that shown in FIG. 1, showing the aerodynamic quantities of interest when an angle of attack exists.
Figure 2B:
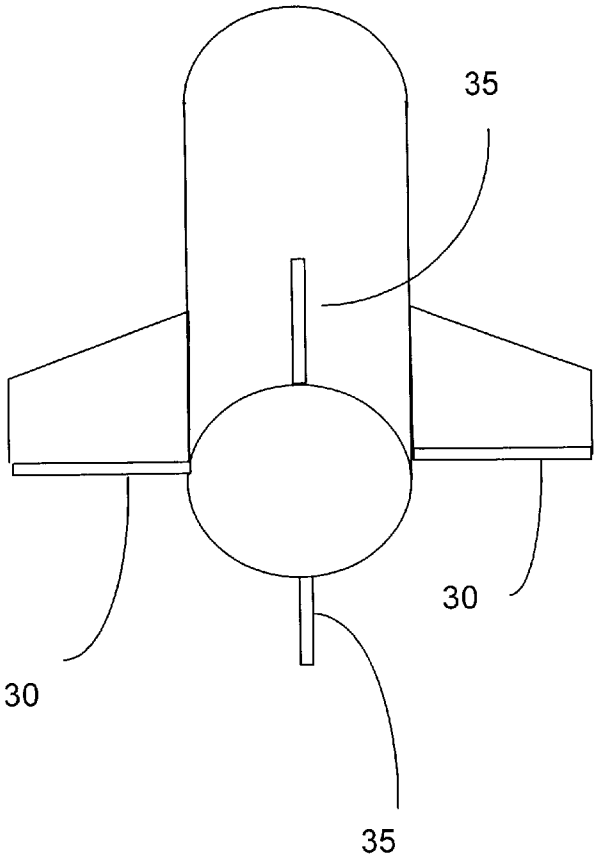
PRIOR ART FIG. 2B

This special case is further illustrated and emphasized in the aft view of FIGS. 2A and 2B where the pair of fins 35 may be observed to lie in the pitch plane and a second pair of fins 30 lies in a plane that is perpendicular to the pitch plane. To first order, the fins 35 lying in the pitch plane provide no lift to correct the angle of attack. The second set of fins 30, orthogonal to the pitch plane, provide the required lift and the restoring moment 45 to reduce the angle of attack and stabilize the projectile 5. While only two of the four tail fins are providing lift, all four fins are producing drag.

Figure 3:
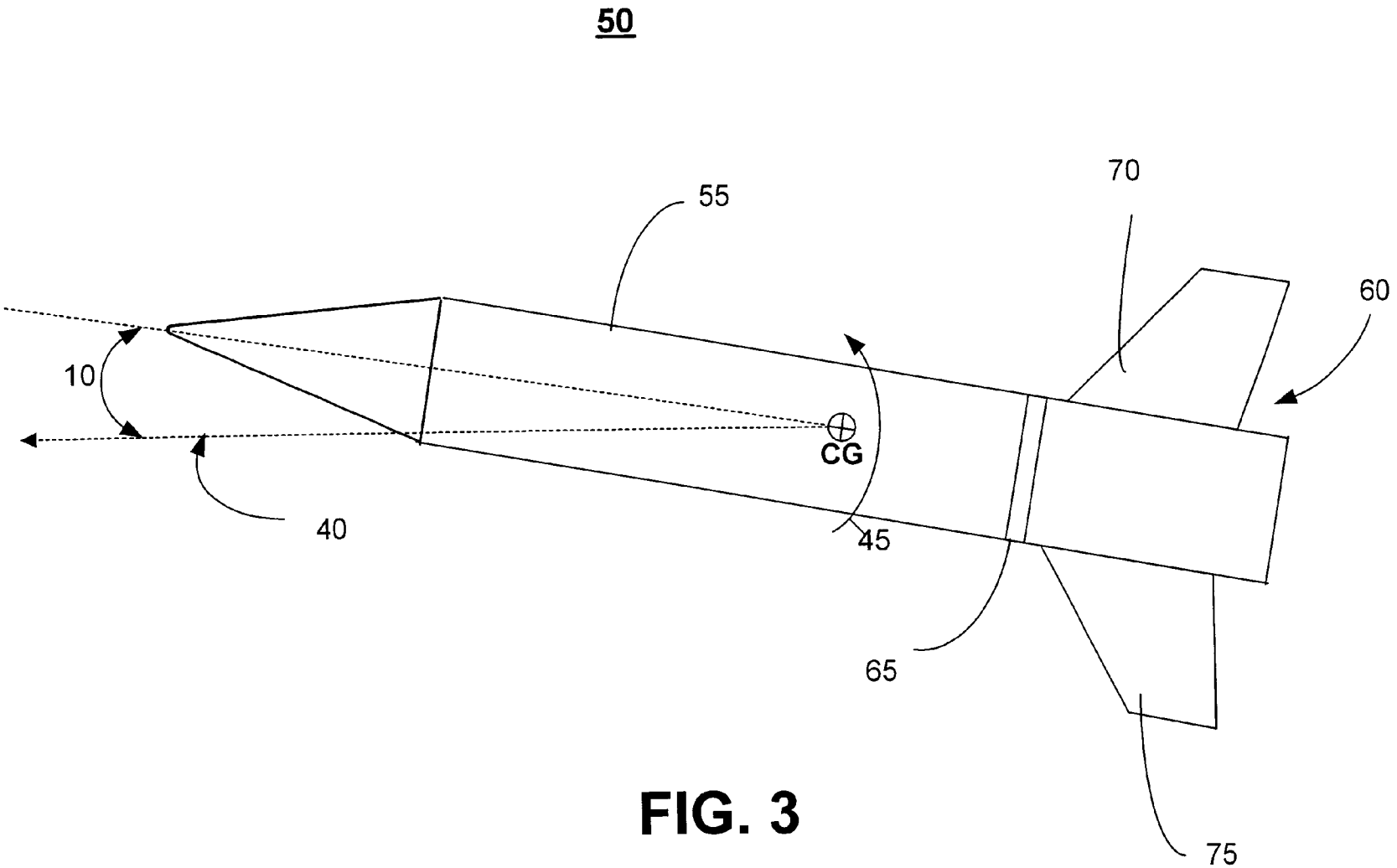
FIG. 3 is a side view of the projectile employing an aft section design according to the present invention which displays improved aerodynamic performance when compared to the projectile of FIG. 1.

FIG. 3 illustrates a projectile equipped with fin-stabilizers according to the present invention 50. As shown, a projectile with a cylindrical forebody 55 is equipped with, or secured to a tail section (also referred to as aft section) 60 that is allowed to rotate freely about the longitudinal axis of the projectile forebody 55 by means of a rotary bearing 65. In a preferred embodiment, the forebody 55 is generally axially co-aligned relative to the aft section 60.

Generally coplanar fins 70 and 75, are affixed to the tail section 60. With the fins 70 and 75 affixed to the tail section 60 and free to rotate about the longitudinal axis of the cylindrical forebody 55 of the projectile 50, they will orient themselves to balance the applied aerodynamic loads that result from a non-zero angle of attack 10. This plane of orientation provides maximum lift to counter the instability caused by the non-zero angle of attack. The design requires that the rotational moment of inertia of the cylindrical forebody 55 greatly exceed that of the tail section 60. Thus, the tail section 60 and the attached fins 70 and 75 may rotate freely with respect to the forebody 55 while causing minimal corresponding rotation of the forebody.

Figure 4:
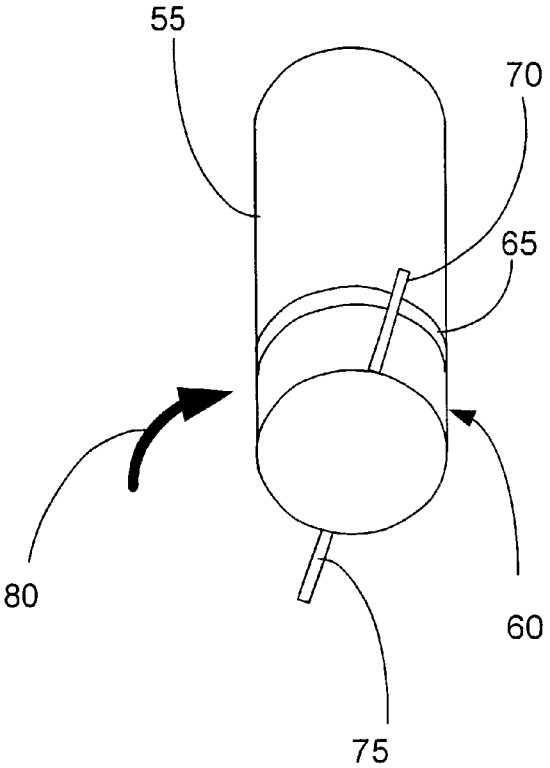
FIG. 4 provides an aft view of the invention of FIG. 3 emphasizing the orientation of the aft section and fins prior to their reaction to a non-zero angle of attack.

FIG. 4 provides aft views of a projectile according to the present invention with added detail of the movement of the tail fins and the accompanying aerodynamic forces. Consider the special case in which a projectile 50 displays a non-zero of attack and, furthermore, where the projectile's pitch plane is parallel to the initial orientation plane of the two fins 70 and 75.

In this case, the aerodynamic loads on the fin blades 70 and 75 are asymmetric, with the windward fin 75 generating more lift than the leeward fin 70. The illustration of FIG. 4 is, thus, consistent with the attitude and orientation of a projectile prior to rotation of the stabilizing fins in response to a non-zero angle of attack. The unbalanced aerodynamic forces on the fins 70 and 75 result in an aerodynamic moment about the longitudinal axis of the projectile which rotates the fins 70 and 75 and tail section 60 along the rotational vector 80. As described in conjunction with FIG. 3, this aerodynamic moment rotates the fins until the forces are balanced.

Figure 5:
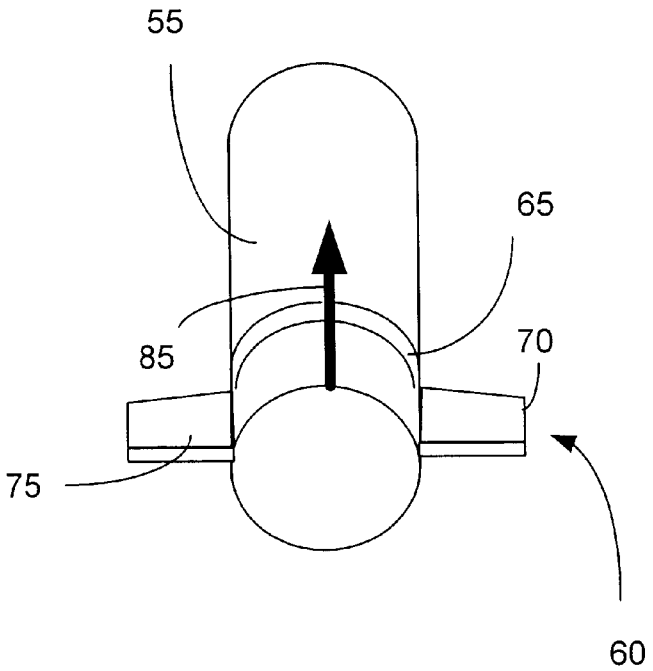
FIG. 5 provides an aft view of the invention of FIG. 3 emphasizing the orientation of the aft section and fins after their reaction to a non-zero angle of attack.

FIG. 5 displays the resulting stable orientation of the aft section with the fins lying in the maximum lift plane 100. This orientation represents the attitude and orientation following the rotation of aft section 60, fins 70 and 75 by means of rotary bearing 65 about the longitudinal axis of the forebody 55, in response to a non-zero angle of attack. In particular, this orientation, with the fins lying in a plane that is orthogonal to the pitch plane, produces maximum lift 85 for countering the effects of a non-zero angle of attack.

It can be understood from these considerations that the roll torque of the tail section and fins is much larger than the resisting torques for the tail inertia and bearing friction, thus allowing the tail section to rotate rapidly as compared to the projectile pitching frequency. Consequently, the tail section is able to rotate quickly in response to the existence of a non-zero angle of attack, placing the fins in the maximum lift plane and providing the required restoring moment to the projectile.

According to this embodiment of the present invention, flight stabilization using the tail fins affixed to a rotating tail section is a passive device. Rotation of the fins into the maximum lift plane is due entirely to the aerodynamic loads generated by a non-zero angle of attack. Fin orientation in the maximum lift plane represents a stable operating point in which aerodynamic forces on the fins are balanced.

Figure 6:
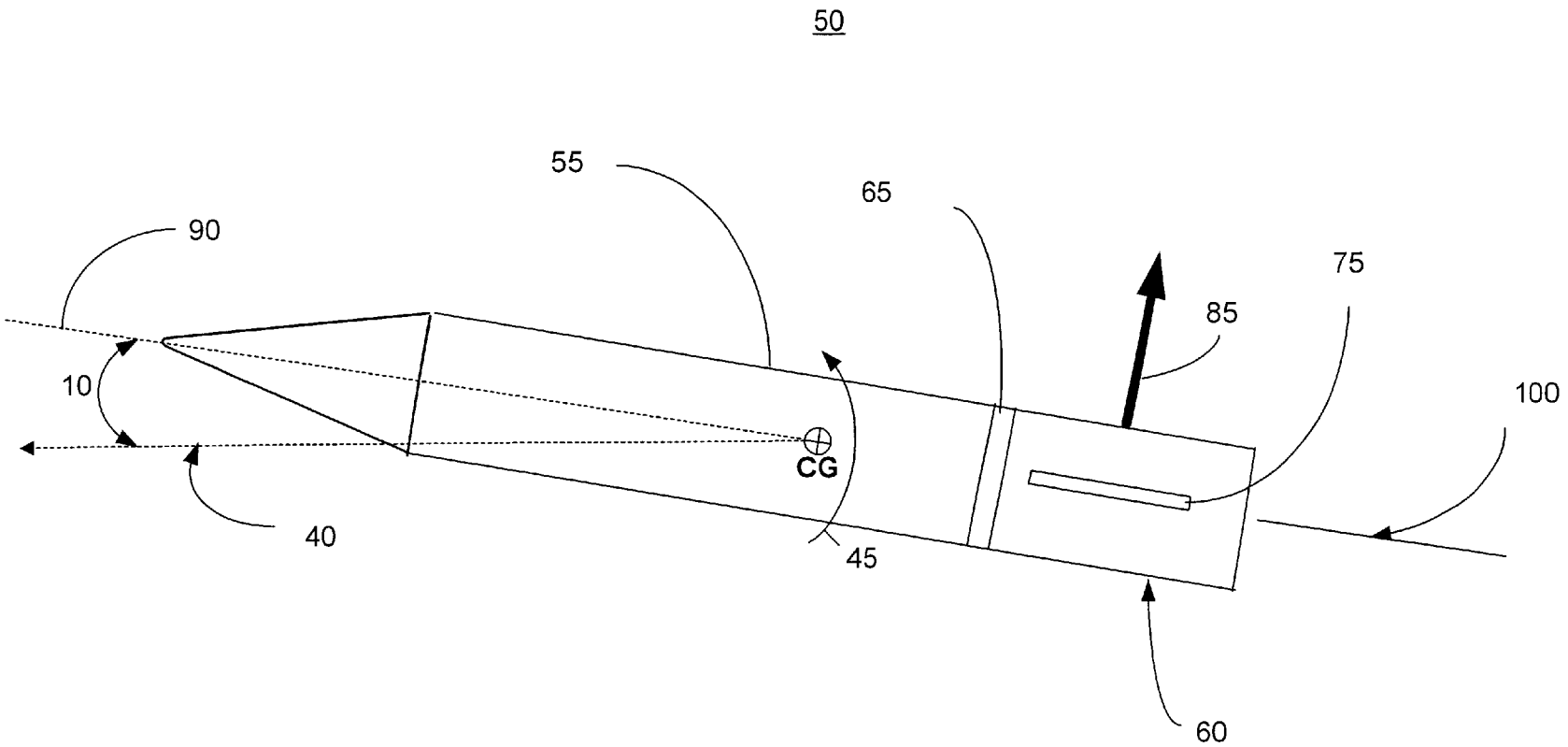
FIG. 6 displays a lateral view of the aerodynamic quantities of interest as they pertain to the present invention of FIG. 3 and illustrates their role in the correction of flight instabilities.

FIG. 6 provides yet another view of the device of the current invention and pertinent quantities associated with the correction of an existing angle of attack. Specifically, a non-zero angle of attack 10 exists, with the velocity vector 40 and the longitudinal axis 90 of the projectile 50 being non-collinear.

As a result, unbalanced forces on the fins in the movable tail section 60, joined to the forebody 55 by means of bearing 65, and as described fully in conjunction with FIG. 3 and FIG. 4, have rotated the fins 70 and 75 into the plane of maximum lift 100. The resulting lift 85 generated by the fins produces an aerodynamic moment that decreases the angle of attack and corrects the existing flight instability.

It should be clear that the lift generated by the fins decreases as the angle of attack decreases and that a zerovalued angle of attack represents a stable operating point. Further, it is clear that the flight correction mechanism defined by this invention is entirely passive yet achieves the desired goals of providing stability to the projectile while decreasing drag. In addition, it is clear that a single pair of stabilizing fins affords minimum drag, thus increasing range and down-range velocity. It should also be apparent that many modifications may be made to the invention without departing from the spirit and scope of the invention.

What is claimed is:

1. A projectile comprising:

an elongated forebody that extends along a longitudinal axis;

a tail section that is rotatably secured to the forebody; and a passive fin-stabilization system including only two stabilizing fins that are secured to the tail section, and that are capable of spinning freely and independently about the longitudinal axis of the forebody during an entire flight period allowing aerodynamic forces to orient the fins in a plane to provide optimal lift for decreasing an angle of attack and for maintaining stability.

2. The projectile according to claim 1, further including a rotary bearing that couples the tail section and the forebody to allow the aft section to rotate freely about the longitudinal axis of the forebody.

3. The projectile according to claim 2, wherein the aft section is generally axially co-aligned with the forebody.

4. The projectile according to claim 3, wherein the forebody is generally cylindrically shaped.

5. The projectile according to claim 4, wherein the aft section is generally cylindrically shaped.

6. The projectile according to claim 1, including only two stabilizing fins.

7. The projectile according to claim 6, wherein the two stabilizing fins are generally co-planarly disposed.

8. The projectile according to claim 6, wherein the two stabilizing fins are disposed so as to cause aerodynamic forces to orient the two stabilizing fins in a plane to provide maximum lift, to decrease an angle of attack, and to maintain stability.

9. The projectile according to claim 1, wherein the tail section includes a rotational moment of inertia;

wherein the forebody includes a rotational moment of inertia; and wherein the rotational moment of inertia of the forebody exceeds the rotational moment of inertia of the tail section, so that during flight, the tail section is capable of rotating relative to the forebody.

10. The projectile according to claim 9, wherein the relative rotation of the tail section with respect to the forebody is a function of a ratio of the rotational moment of inertia of the tail section over the rotational moment of inertia of the forebody.

* * * * *